US011092153B2

(12) United States Patent
Pawellek et al.

(10) Patent No.: US 11,092,153 B2
(45) Date of Patent: Aug. 17, 2021

(54) ELECTRIC GEROTOR PUMP AND METHOD FOR PRODUCING SAME

(71) Applicant: NIDEC GPM GmbH, Auengrund OT Merbelsrod (DE)

(72) Inventors: Franz Pawellek, Lautertal (DE); Conrad Nickel, Troistedt (DE)

(73) Assignee: NIDEC GPM GMBH, Auengrund ot Merbelsrod (DE)

( * ) Notice: Subject to any disclaimer, the term of this patent is extended or adjusted under 35 U.S.C. 154(b) by 183 days.

(21) Appl. No.: 16/344,144

(22) PCT Filed: Oct. 5, 2017

(86) PCT No.: PCT/EP2017/075303
§ 371 (c)(1),
(2) Date: Apr. 23, 2019

(87) PCT Pub. No.: WO2018/082859
PCT Pub. Date: May 11, 2018

(65) Prior Publication Data

US 2020/0182241 A1 Jun. 11, 2020

(30) Foreign Application Priority Data

Nov. 7, 2016 (DE) ..... 10 2016 121 240.7

(51) Int. Cl.
*F03C 2/00* (2006.01)
*F03C 4/00* (2006.01)
(Continued)

(52) U.S. Cl.
CPC ..... *F04C 2/105* (2013.01); *F04C 11/008* (2013.01); *F04C 15/0065* (2013.01); *F04C 15/068* (2013.01); *F04C 2240/40* (2013.01)

(58) Field of Classification Search
CPC ..... F04C 2/103; F04C 2/105; F04C 11/008; F04C 15/0065; F04C 15/068; F04C 2230/60; F04C 2240/40; F04C 2240/51
See application file for complete search history.

(56) References Cited

U.S. PATENT DOCUMENTS 3,572,983 A * 3/1971 McDermott ..... F04C 2/104 418/61.3
3,907,465 A * 9/1975 Dorff ..... F04C 2/102 418/171
(Continued)

FOREIGN PATENT DOCUMENTS

CN 102177343 A 9/2011
DE 12 85 892 B 12/1968
(Continued)

OTHER PUBLICATIONS

JP2010159724 A—Iijima, Oil Pump, Jul. 22, 2010—the English MachineTranslation (Year: 2010).*
(Continued)

*Primary Examiner* — Theresa Trieu
(74) *Attorney, Agent, or Firm* — Patterson Thuente Pedersen, P.A.

(57) ABSTRACT

An electrically driven gerotor pump has a gerotor which comprises a stationary outer gerotor element with an inner toothing that is axially delimited by two chamber walls, wherein each chamber-forming foot section of the inner toothing is paired with a pressure valve which is connected to the outlet. The gerotor also comprises an inner gerotor element with an outer toothing which is guided in the outer gerotor element in a circumferential manner on an eccentric section of the shaft and is mounted in, a rotatable manner so as to mesh with the inner toothing.

8 Claims, 2 Drawing Sheets

(51) Int. Cl.

| | |
|---|---|
| ***F04C 18/00*** | (2006.01) |
| ***F04C 2/00*** | (2006.01) |
| ***F04C 2/10*** | (2006.01) |
| ***F04C 11/00*** | (2006.01) |
| ***F04C 15/00*** | (2006.01) |
| ***F04C 15/06*** | (2006.01) |

(56) References Cited

U.S. PATENT DOCUMENTS

| | | | | |
|---|---|---|---|---|
| 4,813,858 | A | 3/1989 | Eisenbacher | |
| 2004/0062672 | A1 | 4/2004 | Petersen et al. | |
| 2004/0184942 | A1* | 9/2004 | Phillips | F04C 2/102 418/171 |
| 2011/0194954 | A1* | 8/2011 | Sakata | F04D 13/02 417/423.7 |

FOREIGN PATENT DOCUMENTS

| | | | | |
|---|---|---|---|---|
| DE | 37 16 960 | A1 | 12/1987 | |
| DE | 34 44 859 | C2 | 1/1991 | |
| DE | 34 48 253 | C2 | 5/1991 | |
| DE | 44 40 782 | A1 | 7/1995 | |
| DE | 10 2012 210 197 | A1 | 5/2013 | |
| DE | 10 2014 226 002 | A1 | 6/2016 | |
| DE | 10 2015 002 353 | A1 | 6/2016 | |
| DE | 102016121237 | A1 * | 5/2018 | F04C 2/103 |
| EP | 0475109 | A1 * | 3/1992 | F04C 2/102 |
| EP | 0 579 981 | A1 | 1/1994 | |
| EP | 2 336 565 | A1 | 6/2011 | |
| JP | 2010159724 | A | 7/2010 | |
| JP | 2012225263 | A | 11/2012 | |
| WO | WO 2007/034301 | A1 | 3/2007 | |

OTHER PUBLICATIONS

PCT International Search Report and Written Opinion for International Application No. PCT/EP2017/075303, dated Dec. 21, 2017, 14 pages.

English translation of PCT International Search Report for International Application No. PCT/EP2017/075303, dated Dec. 21, 2017, 3 pages.

DE Examination Report for 10 2016 121 240.7, dated Sep. 8, 2017, 6 pages.

Japanese Office Action and English Language Summary from JP Application No. 2019-523741, dated Jul. 14, 2020, 6 pgs.

Office Action for CN 201780068004.5 dated Dec. 17, 2019, 8 pages.

English translation of Office Action for CN 201780068004.5 dated Dec. 17, 2019, 5 pages.

* cited by examiner

ELECTRIC GEROTOR PUMP AND METHOD FOR PRODUCING SAME

RELATED APPLICATIONS

This application is a National Phase entry of PCT Application No. PCT/EP2017/075303 filed Oct. 5, 2017, which application claims the benefit of priority to German Application No. 10 216 121 240.7, filed Nov. 7, 2016, the entire disclosures of which are incorporated herein by reference.

FIELD OF THE INVENTION

The invention relates to an electrically driven gerotor pump and a method for producing an embodiment of the gerotor pump.

BACKGROUND OF THE INVENTION

Electric gerotor pumps, also called gear pumps, are well known as auxiliary devices, for example, such as oil pumps, power steering pumps for steering assistance or hydraulic pumps in gear units. For implementations with compact dimensions, a gerotor type has become prevalent in which an outer rotor meshingly engages with an eccentrically arranged inner rotor via teeth and both rotate in the same direction. While the driven inner rotor drags the outer rotor via the meshing engagement, a displacement is effected in an endless, circumferential series of crescent-shaped working chambers in the teeth. DE 10 2015 002 353 A1, for example, shows such a gerotor pump in a configuration typical for its application as an electric oil pump or an auxiliary pump.

When used in mobile applications, such as in vehicle construction, pumps and their hydraulic circuits are subjected to great fluctuations in temperature, which leads to fluctuating power demand from the electric drive as a function of the viscosity of a hydraulic medium. Particularly when cold-starting a vehicle, considerably higher electric power is required than during subsequent operation in order to start the pump and the circuit when oil viscosity is high and the shaft rotational speed is low, and particularly against the resistance of a breakaway torque at standstill.

When a voltage available from the vehicle electrical system is limited, high peak currents flow briefly for this power demand, which in turn requires a correspondingly high dimensioning of the power electronics, line cross-sections, stator coils and the like. Providing power reserves for cold-start conditions with an electric drive that is large compared to a rated output at which the electric pump takes in considerably lower currents on a permanent basis during operation, leads to considerable disadvantages with respect to weight, overall size and production costs from an economic point of view. In addition, suitable larger electric drives often require additional sensor technology and control systems, such as an angle sensor in order to detect a rotor position and the like, which represent another cost factor and increase the complexity of the drive.

SUMMARY OF THE INVENTION

Therefore, it is an object of the invention to provide an electrically driven gerotor pump that enables the use of a more economic electric motor for the same rated output of the pump.

This object is achieved according to the present invention with an electrically driven gerotor pump having the features of claim 1.

The electrically driven gerotor pump according to the present invention is particularly characterized by a gerotor that includes a stationary outer gerotor element having internal teeth which is axially delimited by two chamber walls, each chamber-forming root portion of the internal teeth having an allocated pressure valve communicating with an outlet; and includes an inner gerotor element having external teeth which is circumferentially guided and rotatably mounted on an eccentric portion of the shaft in the outer gerotor element so as to meshingly engage the internal teeth.

The invention therefore provides an electrically driven gerotor pump with a stationary outer gerotor element for the first time.

Compared with the gerotor type conventionally used in electric pumps, where the outer rotor is dragged by a driven inner rotor, there is no sliding rotational motion of the outer rotor when it is dragged by the inner rotor in the assembly according to the present invention of an electric pump. Due to the omission of the moving outer rotor, the stationary outer gerotor element achieves a considerably lower frictional resistance and a lower breakaway torque, particularly when the hydraulic medium, which simultaneously provides the lubrication of the sliding bearings, has a high viscosity. As a result of its construction, the outer rotor of the gerotor type of conventional electric pumps has the largest possible pair of sliding surfaces at the outer circumference; accordingly, a large surface is in contact with the viscous hydraulic medium and particularly high torque is required in order to overcome a breakaway torque during start-up in case of a cold start.

In the assembly of the electric gerotor pumps according to the present invention, which comprises a stationary outer gerotor element, this characteristic of the bearing of an outer rotor was identified as a crucial problem, and by avoiding it in the assembly, a possible solution having the following additional advantages is proposed for achieving the object.

Due to the omitted sliding bearing surfaces and the correspondingly lower breakaway torque, the viscosity has less effect, and therefore, disproportionate power reserves of the electric drive for cold-start conditions can be largely reduced such that a drive size may approach a rated output of the pump more closely and a considerable advantage with regard to weight, size and costs may be achieved. Depending on the use, a rotation angle sensor for monitoring a control function or blocking of the drive may be omitted, which makes it possible to further reduce complexity and production costs.

Furthermore, the lower frictional resistance is also achieved due to the inner gerotor element of the assembly of the electric gerotor pumps according to the present invention. Compared to a gerotor type with a driven inner rotor and a dragged outer rotor, the inner gerotor element is subject to considerably lower rotational speed when it circumferentially rolls off the stationary internal teeth of the outer gerotor element on the eccentrically guided circular path, which may be compared with a spirograph for drawing pens or pencils. il To be more precise, the rotational speed of the inner gerotor element in the assembly of the electric gerotor pump according to the present invention is reduced by 1/number of the inner teeth of the outer gerotor element, i.e., in the present case to ⅕th of the rotational speed compared with a pump having two moving rotors. This reduction in rotational speed has a particularly great impact during operation in terms of lower frictional resistance against sliding contacts, sealing the front face, of the inner gerotor element towards the chamber walls, which also represent a large pair of sliding surfaces.

This not only removes the frictional losses of an outer rotor but also reduces those stemming from the rotation of an inner rotor compared to a conventional assembly, and it improves the efficiency of an electric gerotor pump in continuous operation.

A few implementations of a gerotor having a stationary outer gerotor element are known in the state of the art. However, such gerotor types generally have a complex assembly, since a great number of check valves or pressure valve are required for separate exits from each working chamber due to the fact that there is no revolving of the working chambers. Therefore they are primarily designed specifically for hydraulic systems with a high load where preventing a return flow in an idle state and maintaining a pressure is required.

Pumps described above having a more complex assembly are known from DE 44 40 782 A1 and DE 37 16 960 A1, which are designed for being driven by a combustion machine and have features with respect to the shaft bearing and valve types that are designed for stability when displacing under high pressure; however, due to relatively high costs, those features also exclude the gerotor type from being used for the present application to achieve the object.

The constructions of a gerotor known in the state of the art having a stationary outer gerotor element have not been economically successful in either applications of medium performance classes and compact constructional shape, nor in applications of low performance classes and a corresponding miniaturization of the configurational shape due to their complex assembly.

In contrast thereto, the invention makes a new application for a gerotor having a stationary outer gerotor element with an electric drive in a lower performance class possible, in which performance losses due to frictional resistance are much more important, and in which countermeasures such as dimensioning of the electric motor or sensor technology are extremely limited while keeping manufacturing of large quantities profitable. According to the present invention, it has been found for the first time that despite choosing a hydraulically more complex gerotor type for the pump group, the latter offers a greater advantage with respect to the dimensioning of the motor assembly.

Advantageous further developments of the electrically driven gerotor pump which facilitate a simplifying optimization of the gerotor for the performance class and a more economic production are the subject matter of the dependent claims.

According to one aspect of the invention, the eccentric portion of the shaft on which the inner gerotor element is circumferentially guided and rotatably mounted may be formed as an eccentric extension at a free end of the shaft.

The invention therefore provides, for the first time, a one-sided shaft bearing at a circumferential displacement pump or gerotor pump, particularly one having a stationary outer gerotor element. The assembly according to the present invention of the gerotor pump therefore proposes an application-specific optimization of this gerotor type considering a low or medium hydraulic performance class up to, e.g., 1.5 kW.

In addition, the construction enables a smaller axial dimension of the pump assembly achieved on the opposing side of the shaft bearing. By following this principle, an embodiment may be provided in which an axial dimension of the pump assembly ends directly at a front-face delimitation of the gerotor.

The omission of a second bearing for the gerotor furthermore leads to a lower total number of elements, which, when manufacturing large quantities, has a positive impact on cost-optimization in terms of material costs, production steps for manufacturing the elements, their installation costs and finally the required production time.

According to one aspect of the invention, a bearing of the shaft may be arranged inside the housing in a single axial shaft portion and the bearing may comprise at least two rows of roller bodies.

The shaft bearing comprises two axially adjacent rows of roller bodies that absorb breakdown torque between a drive side, illustrated on the left, and a pump side, illustrated on the right, and divert it to the pump housing.

According to one aspect of the invention, a link between the inlet and the chamber-forming root portions of the internal teeth of the outer gerotor element may extend through the free end of the shaft, a control slot in the eccentric extension, and a radial branch to root portions of the external teeth in the inner gerotor element.

The control slot makes a geometrical constraint control available, which effects a connecting and locking functionality between the pump inlet and the working chambers as a function of an angle range of increasing volumes and an angle range of decreasing volumes in the working chambers on either side of the meshing engagement.

According to one aspect of the invention, a chamber wall may close an open axial end of the pump housing and accommodate an orifice of the inlet and the outlet.

This configuration provides a constructional shape with particularly short axial dimensions and a low number of elements.

According to one aspect of the invention, the pressure valves may be formed by radial opening slots in the outer gerotor element which are covered with respect to an annular outlet chamber around the outer gerotor element by clasp-like bent sheet-metal parts with a turnaround section.

This configuration is advantageous in terms of manufacturing and yet functional for producing an assembly of several pressure valves or back pressure valves. In addition, a constructional shape with displacement flows radially exiting the working chambers is provided, which makes an implementation of short axial dimensions of the pump having the valves that are advantageous in terms of manufacturing available.

According to one aspect of the invention, the chamber walls may have a surface structure with a regular or irregular pattern applied at a depth of preferably 1 to 2 μm on the front faces facing the gerotor.

By applying a micro structure on the surface of the chamber walls by means of an electrochemical treatment or laser irradiation, the tribometric characteristics and therefore the efficiency is improved. The micro structure effects an improved accumulation of the long-chain oil molecules on the material surface and arranges for a better adherence of a remaining lubricating film between the sliding areas at peak pressures such as those that increasingly occur partially when shear forces act on the inner gerotor element, for example.

According to one aspect of the invention, the pump housing may have, on inner surfaces, axial portions with cylindrical lateral surfaces, i.e. shell surfaces, which fit in a fixing manner to a cylindrical outer circumferential portion of a shaft seal, a bearing of the shaft, at least one of the two chamber walls, and the outer gerotor element.

By providing press fits between the pump housing and all internal elements, seals as well as screw connections and fasteners between them, such as screws or the like, can be dispensed with.

According to one aspect of the invention, a gerotor pump according to the present invention having the press fits mentioned above may be manufactured with the following steps: press-fitting a shaft seal, a shaft bearing including the shaft, a first front-face chamber wall and the stationary outer gerotor element inside the pump housing in this axial order; intermediately or subsequently sliding an eccentric extension of the shaft into a press-fitted bearing of the inner gerotor element; fixing a second front-face chamber wall in the pump housing by press-fitting or welding; intermediately or subsequently press-fitting the other end of the shaft into the motor rotor; inserting and fixing the motor stator together with motor electronics as well as the motor cover.

By assembling and fixing all elements with press-fitting processes, there is no manufacturing expenditure for cutting threads and introducing receiving grooves for seals or any assembly expenditure for screw connections, screws and seals. If the gerotor pump is designed for a low performance class, the strength and sealing of a press fit at an outlet-side chamber wall or at an outlet-side pump cover may be sufficient. If the gerotor pump is designed for a medium performance class, e.g., 20 to 150 bar, it may be necessary to use a different joining technique, such as a welded connection, between the pump housing and an outlet-side chamber wall as a pump cover.

BRIEF DESCRIPTION OF THE DRAWINGS

The invention is described below in detail based on two embodiments with reference to the accompanying drawings. They show.

DETAILED DESCRIPTION OF THE DRAWINGS

The assembly of the electrically driven gerotor pump according to the present invention is described below with reference to FIGS. 1 and 2.

Figure 1:
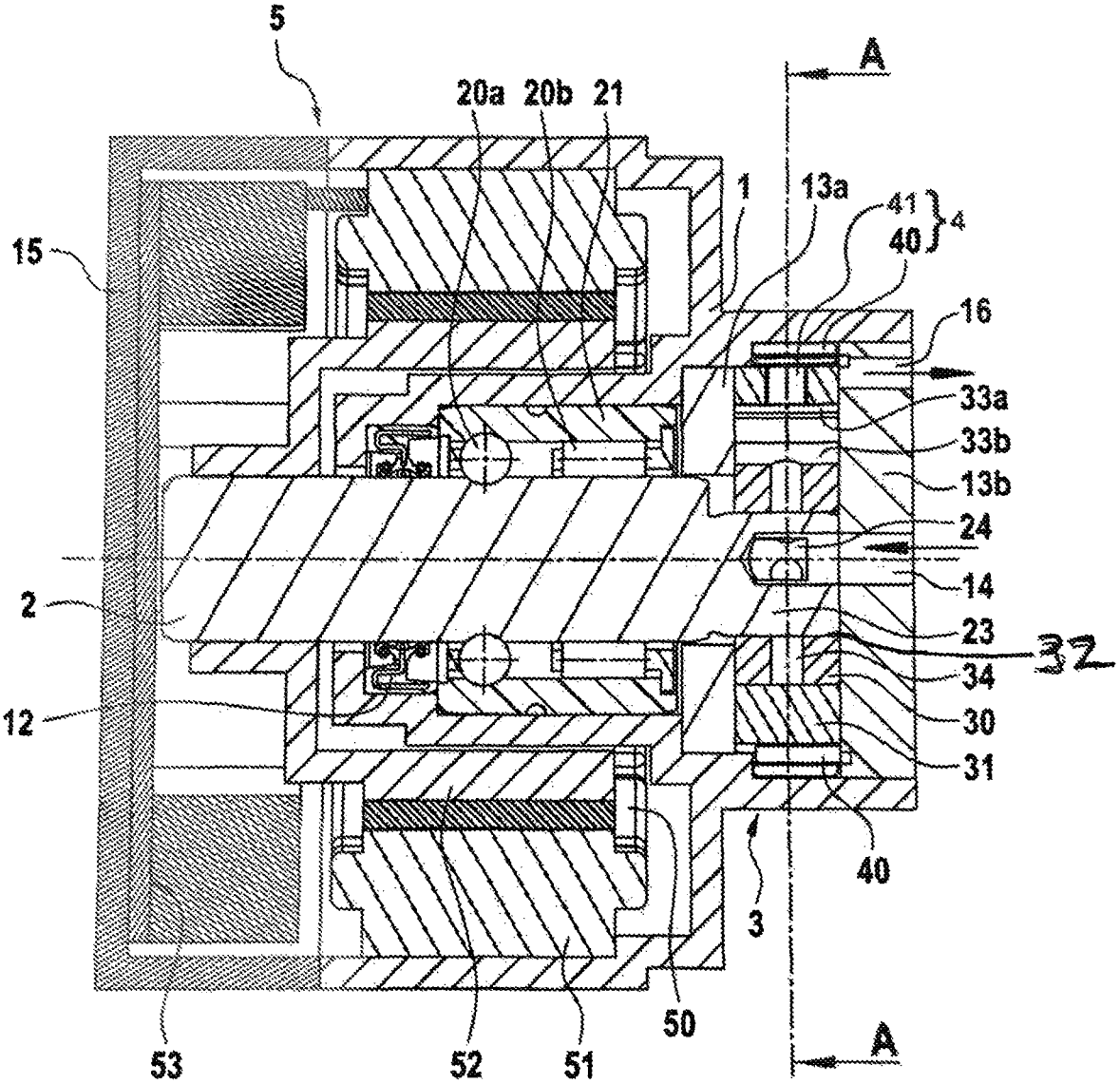
FIG. 1 is a longitudinal section through the electrically driven gerotor pump according to the present invention.

As may be seen in FIG. 1, the pump housing 1 includes a radially internal housing portion open to one axial side, and a radially exterior housing portion open to the other axial side. A shaft seal 12, a shaft 2 with a bearing 21, as well as the gerotor 3, and the chamber walls 13*a*, 13*b* are accommodated in the internal housing portion. The electric drive 5 is accommodated with the stator 51, motor electronics 50 and the motor rotor 52 in the exterior housing portion.

The motor rotor is connected with an end section of the shaft 2, situated opposite of the gerotor 3, and radially surrounds the internal housing portion or axially reaches across it towards the shaft center. The motor stator 51 is fixed around the motor rotor 52 against an inner surface of the outer wall of the exterior housing portion at the pump housing 1. An open drive-side end of the pump housing 1 is closed by a motor cover 15 in which motor electronics 50 with a circuit board, power electronics with power supply terminals, and a pump ECU are embedded.

A shaft bearing 21 is arranged between the shaft circumference and an inner lateral surface i.e., shell surface, of the internal housing portion at an axial portion of the shaft 2 accommodated in the pump housing 1. The shaft bearing 21 corresponds to the type of water pump bearing known from its use in centrifugal pumps. The shaft bearing 21 includes two axially adjacent rows of roller bodies 20*a* and 20*b*. A row of roller bodies 20*a* with spherical roller bodies, circumferentially guided between two opposing rounded grooves in the shaft 2 and the shell of the bearing 21, absorbs radial and axial forces at the shaft 2. A row of roller bodies 20*b* with cylindrical roller bodies, corresponding to a needle bearing, absorbs radial forces and ensures a sufficient absorption of breakdown torque at the shaft axis despite a low axial distance between the bearing positions.

At a free end of the shaft 2 behind the shaft bearing 21, an eccentric shaft extension 23, which has a smaller circumference than the shaft circumference and whose central axis of the circle circumference is eccentrically displaced towards a shaft axis, extends in an axial direction further into the pump housing 1. The assembly of the gerotor 3 is accommodated in an axial extension portion of the shaft extension 23 between the same and the pump housing 1.

The gerotor 3 includes an outer gerotor element 31 and an inner gerotor element 30. The outer gerotor element 31 is stationarily fixed in an internal lateral surface, i.e., shell surface, of a flange portion of the pump housing 1 and comprises internal teeth 33*a*. Within the outer gerotor element 31, the inner gerotor element 30 comprising external teeth 33*b* is arranged on the eccentric shaft extension 23. The inner gerotor element 30 is rotatably mounted on the eccentric shaft extension 23 with a sliding bearing 32 and is circumferentially guided, when the shaft 2 rotates, by the eccentric displacement of the shaft extension 23 to the shaft axis, i.e., the axis of rotation of the shaft 2, on a circular path within the stationary outer gerotor element 31. Meanwhile, the inner gerotor element 30 and the outer gerotor element 31 meshingly engages in a way that is characteristic for gerotor types.

The gerotor 3 is axially delimited by two chamber walls 13*a* and 13*b* as shown in FIG. 1. In a radial area of the stationary outer gerotor element 31, in which the crescent-shaped working chambers of the internal teeth 33*a* are located, the chamber walls 13*a* and 13*b* are in stationary surface contact with the front faces of the outer gerotor element 31. At the same time, the chamber walls 13*a* and 13*b* are in sliding contact with the front faces of the inner gerotor element 30 in the same radial area. In this way, the pumping medium is enclosed between the internal teeth 33*a* and the external teeth 33*b* at the axial delimitation.

On the eccentrically guided circular path of the inner gerotor element 30, the latter rolls off the external teeth 33*b*. At the same time, a circumferential, endless series of gradually engaging and releasing displacement actions takes place in the area of the meshing engagement in the crescent-shaped working chambers formed in the root portions of the internal teeth 33*a* of the outer gerotor element 31. An entry and an exit, described below, are provided for the pumping medium into and out of each working chamber, and the principle of operation of a circumferential displacement device is created.

An inlet bore, extending as a blind hole through the chamber wall 13*b* in the eccentric extension 23 of the shaft 2, extends along a rotation axis of shaft 2 and simultaneously forms the inlet 14 of the pump. As illustrated in FIGS. 1 and 2 from different perspectives, the eccentric extension 23 has a control slot 24 that, within an axial portion of the inner gerotor element 30, takes up an arc segment of the circumference of the eccentric extension 23 stretching into the inlet bore. A radial branch of entry ducts 34 is formed in the inner gerotor element 30, extending between an intersection of the circumferential control slot 24 and the root portions of the external teeth 33*b*.

A rotational angle range, to which the control slot 24 is cut out or opened, is directed, in the eccentric extension 23, to the side of the meshing engagement where the volumes of the crescent-shaped working chambers in the internal teeth 33*a* increase, i.e., on a rearward side with respect to the circumferential direction of the eccentric extension 23. The control slot 24 thereby controls a filling of the working chambers such that always those working chambers, of which the volumes increase again after the meshing engagement, are connected with the inlet 14 of the pump via an allocated entry duct 34. In contrast, an extension of the rotational angle range of the control slot 24 is selected such that a connection between the inlet 14 and such entry ducts 34 allocated to working chambers with decreasing volumes before and during the meshing engagement is blocked.

Exit ducts, which exit from the root points of the internal teeth 33*a*, are formed towards the radially opposite side of the working chambers as radial opening slots 41 in the stationary outer gerotor element 31. The opening slots 41 are part of a plurality of back pressure valves or pressure valves 4, the number of which corresponds to the working chambers of the internal teeth 33*a*. The pressure valves 4 are formed by the radial opening slots 41 and several elastic bent sheet-metal parts 40. A bent sheet-metal part 40 covers the outlet-side orifice of the opening slots 41 and can thereby be pushed back from a covering position over the orifice by a pre-determined pressure in each opening slot 41.

Figure 2:
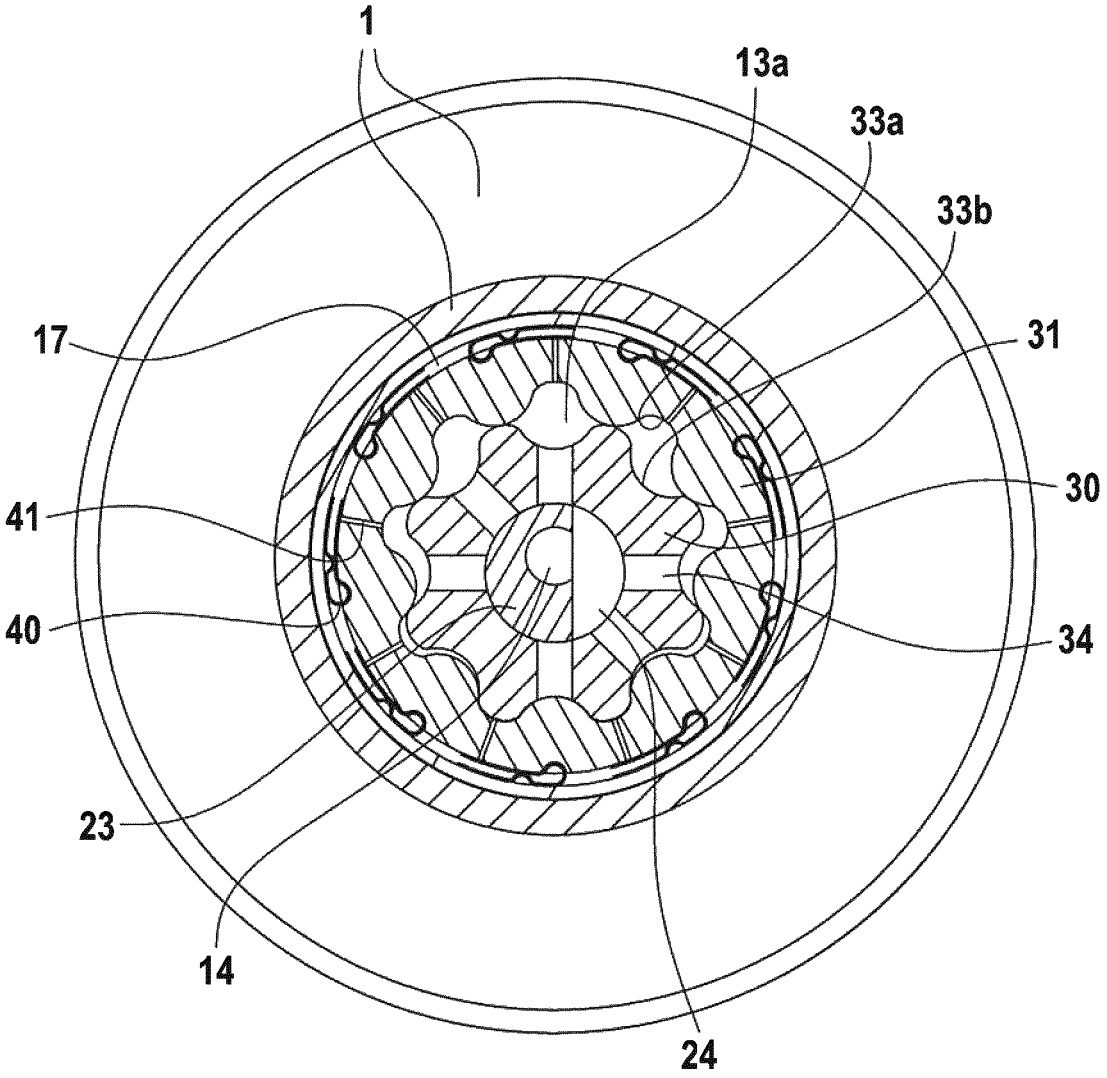
FIG. 2 is a cross-section of the gerotor taken from a cutting plane A of FIG. 1.

As shown in FIG. 2, the bent sheet-metal parts 40 have a cross-section with a turnaround section for forming a double-layer clasp shape. To be more precise, the bent sheet-metal parts 40 furthermore comprise, in the cross-section, a bulge in a sheet-metal layer in order to create a gap between the free ends of the double-layer clasp shape, which effects an elastic bias corresponding to a bending beam or a cantilever against the exit orifice of an opening slot 41. In the area of the free ends, i.e., opposite of the turnaround section, each bent sheet-metal part 40 respectively covers one opening slot 41 and is furthermore spread into an annular exit chamber 17 in a pre-stressed manner. In addition, the bent sheet-metal parts 40 are fixed using an interlocking engagement between an elevation of the turnaround section and a corresponding cutout in the circumference of the outer gerotor element 31, in order to resist the hydraulic medium bypassing in a circumferential direction.

The annular exit chamber 17 is formed by an outer circumference or a circumferential step of the outer gerotor element 31 and an inner shell portion of the pump housing 1 or a ring section of the outer gerotor element 31 allocated for this purpose and serves to gather the circumferentially exiting displacement flows and deliver them to an opening of the pump outlet 16. The chamber wall 13*b* accommodates both the pump outlet 16 and the pump inlet 14.

As is apparent from FIGS. 1 and 2, the entire pump assembly may be implemented without any screw connections. To this end, the individual elements are press-fitted through the two opposite open sides of the pump housing 1 in an axial order from the shaft seal 12 via the shaft 2 together with the shaft bearing 21, the chamber wall 13*a*, and the outer gerotor element 31 with the bent sheet-metal parts 40, into the internal housing portion of the pump housing 1 that makes corresponding, dimensionally stable press fittings available as staggered cylindrical inner lateral surfaces. Furthermore, the inner gerotor element 30 is slid onto the eccentric shaft extension 23 together with the press-fitted sliding bearing 32. Then, the chamber wall 13*b* is either press-fitted or welded, depending on the pressure range the pump is designed for. In the meantime or afterwards, a portion, protruding from the internal housing portion, of the shaft 2 is press-fitted into the motor rotor 52 on the opposite side, and the motor stator 51, together with the motor electronics 50, as well as the motor cover 15, are pushed into the exterior housing portion of the pump housing 1 and fixed.

The embodiments above are intended to be illustrative and not limiting. Additional embodiments may be within the claims. Although the present invention has been described with reference to particular embodiments, workers skilled in the art will recognize that changes may be made in form and detail without departing from the spirit and scope of the invention.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

The invention claimed is:

1. An electrically driven gerotor pump comprising:

a pump housing in which a shaft is rotatably mounted and in which a gerotor, an inlet and an outlet are included;

an electric drive with a motor stator and a motor rotor, which is connected to the shaft and which rotationally drives the gerotor;

wherein the gerotor comprises a stationary outer gerotor element with a plurality of internal teeth which is axially delimited by two chamber walls, each chamber-forming root portion of the internal teeth having associated therewith a pressure valve communicating with the outlet;

an inner gerotor element with a plurality of external teeth which is circumferentially guided and rotatably mounted on an eccentric portion of the shaft in the outer stationary gerotor element so as to meshingly engage the internal teeth;

and a link between the inlet and the chamber-forming root portions of the internal teeth of the stationary outer gerotor element extends through a free end of the shaft, a control slot in an eccentric extension and a radial branch to root portions of the external teeth in the inner gerotor element.

2. The electrically driven gerotor pump according to 1, wherein the eccentric portion of the shaft on which the inner gerotor element is circumferentially guided and rotatably mounted is formed as an eccentric extension on a free end of the shaft.

3. The electrically driven gerotor pump according to 2, wherein a bearing of the shaft is arranged in the pump housing in a single axial shaft portion and comprises at least two rows of roller bodies.

4. The electrically driven gerotor pump according to claim 1, wherein a chamber wall closes an open axial end of the pump housing and includes orifices of the inlet and outlet.

5. The electrically driven gerotor pump according to claim 1, wherein the pressure valves are formed by radial opening slots in the stationary outer gerotor element which are covered with respect to an annular outlet chamber around the outer stationary gerotor element by clasp-like bent sheet-metal parts with a turnaround section.

6. The electrically driven gerotor pump according to claim 1, wherein the chamber walls have a surface structure with a regular or irregular pattern applied at a depth of 1 to 2 μm on the front faces facing the gerotor.

7. The electrically driven gerotor pump according to claim 1, wherein on inner faces the pump housing has axial portions with cylindrical lateral surfaces, which fit in a fixing manner to a cylindrical outer circumferential portion of a shaft seal, a bearing of the shaft, at least one of the two chamber walls and the stationary outer gerotor element.

8. A method for producing electrically driven gerotor pump, comprising the steps of:

press-fitting, in this axial order, a shaft seal, a shaft bearing including a shaft, a first front-face chamber wall and a stationary outer gerotor element into a pump housing having, an inlet and an outlet; wherein the stationary outer gerotor element comprises a plurality of internal teeth which are axially delimited by two chamber walls, each chamber-forming root portion of the internal teeth having associated therewith a pressure valve communicating with the outlet;

intermediately or subsequently sliding an eccentric extension of the shaft into a press-fitted stationary bearing of an inner gerotor element; the inner gerotor element with a plurality of external teeth which is circumferentially guided and rotatably mounted on an eccentric portion of the shaft in the stationary outer gerotor element so as to meshingly engage the internal teeth, and a link between the inlet and the chamber-forming root portions of the internal teeth of the stationary outer gerotor element extends through a free end of the shaft, a control slot in an eccentric extension and a radial branch to root portions of the external teeth in the inner gerotor element;

fixing a second front-face chamber wall in the pump housing by press-fitting or welding;

intermediately or subsequently press-fitting the other end of the shaft into a motor rotor for rotationally driving the gerotor; and inserting and fixing a motor stator with motor electronics as well as a motor cover.

* * * * *